United States Patent [19]

Cech

[11] 4,134,493

[45] Jan. 16, 1979

[54] PACKING RECEPTACLE

[75] Inventor: Karl Cech, Mödling, Austria

[73] Assignee: AKG Akustische u. Kino-Geräte Gesellschaft m.b.H., Austria

[21] Appl. No.: 856,986

[22] Filed: Dec. 2, 1977

[30] Foreign Application Priority Data

Dec. 6, 1976 [AT] Austria ..... 9000/76

[51] Int. Cl.[2] ..... B65D 5/50

[52] U.S. Cl. ..... 206/45.19; 229/9; 206/485; 206/326

[58] Field of Search ..... 229/14 C, 9; 206/806, 206/319, 320, 326, 485, 45.19, 45.14

[56] References Cited

U.S. PATENT DOCUMENTS

| | | | |
|---|---|---|---|
| 536,544 | 3/1895 | Schmidt | 229/9 X |
| 1,932,705 | 10/1933 | Menten | 229/9 X |
| 2,314,491 | 3/1943 | Greenberg | 229/14 C |
| 2,481,302 | 9/1949 | Fogel | 229/9 X |
| 2,582,476 | 1/1952 | Buttery | 206/45.19 |
| 2,609,091 | 9/1952 | Rothe et al. | 229/14 C X |
| 2,927,687 | 3/1960 | Samford | 206/45.19 |

*Primary Examiner*—Davis T. Moorhead

*Attorney, Agent, or Firm*—McGlew and Tuttle

[57] ABSTRACT

A packing receptacle for an article to be packed, in particular a headset, comprises a box and an insert which is removable from the box. The insert comprises a base part having an upstanding end wall at each end with a slot therein for securing the headset to the end walls and for supporting the head set on the base. When the insert is inside of the box, it holds the headset in the box in a manner such that it will be centered in respect to the walls of the box and held away from the walls in a protected position. When the insert is outside of the box, it comprises a stand which supports the headset for display or storage purposes.

6 Claims, 3 Drawing Figures

PACKING RECEPTACLE

FIELD AND BACKGROUND OF THE INVENTION

The present invention relates to packaging devices in general and, in particular, to a new and useful packing receptacle, particularly for headsets, which comprises a box with an insert which is removable from the box.

DESCRIPTION OF THE PRIOR ART

Packing receptacles with inserts are employed for the shipping or transporting of headsets. Experience has shown, however, that for certain types of headsets, particularly those with soft ear pads of foam materials, the packing receptacles of the prior art, even if they comprise an insert forestalling the movements of the packed article during transportation, are unsatisfactory because after long storage of the headset in the packing receptacle, the ear pads become compressed, whereby, they not only lose their pleasing aspect, but also may no longer perform their function of fitting snugly against the head, and this reduces the quality of reproduction. It is therefore of great importance to provide a packing receptacle for retaining the headset firmly within the receptacle, but also in a manner such that the ear pads remain free in the box while the headset as such is prevented from moving even under shaking conditions. The insert should be usable not only for protecting the packed article but also for display purposes and for storing of the article.

SUMMARY OF THE INVENTION

In accordance with the invention, it is provided that the insert and the article to be packed form a loosely assembled unit and that when the insert is within the box, it serves as a protection against damages during transportation and, when it is outside of the box, the insert serves as a support for displaying and storing the article to be transported in the packing receptacle.

A further feature of the invention is that the insert comprises a base panel designed as a supporting surface, and side panels are provided, which extend upwardly from opposite edges of the base panel and have openings and/or slots, by means of which the article to be packed can be fixed in a definite position.

According to a development of the invention, the upwardly extending side panels are connected at their free ends to another panel which is provided at its rear edge with a strip having openings or loops. This design also makes it possible to suspend the packed article, fixed in the insert, from a wall or the like.

Since the insert is also intended for displaying the article to be packed, it may be designed in contradistinction to inserts of the prior art as a stable and rigid structure, and this is also advantageous for the purchaser since he may use the insert for proper permanent storage of the packed article, for example a headset, without risking damage to the headset caused by improper storage thereof.

Accordingly, it is an object of the invention to provide a packing receptacle for an article to be packaged, such as a headset, which comprises a box and an insert which is insertable or removable from the box which comprises a base portion and a wall portion at each end of the base portion having an opening therein for supporting a headset both in the box in a safe and protected position and out of the box, in a display position.

A further object of the invention is to provide a packing receptacle for headsets which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which preferred embodiments of the invention are illustrated.

DESCRIPTION OF THE PREFERRED EMBODIMENTS

Figure 1:
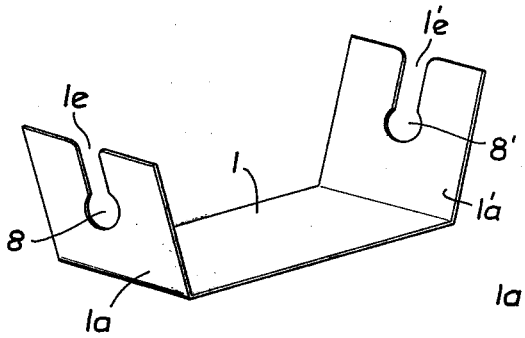
FIG. 1 is a front perspective view of an insert constructed in accordance with the invention.

Referring to the drawing in particular, the invention embodied therein in FIG. 1, shows the inventive insert in a simplified perspective view. The insert comprises a rectangular base panel 1 which, at the same time, serves as a supporting surface for display or for storing with the purchaser. Two side panels 1*a* and 1*a'* extend upwardly or outwardly from the short edges of base panel 1 and each has an opening 8, 8' for receiving an extension of the earpiece. To facilitate the insertion of the headset, slots 1*e*, 1*e'* are provided which are slightly narrower than openings 8, 8' to obtain a certain clamping of the headset in the retaining structure of the insert.

Figure 2:
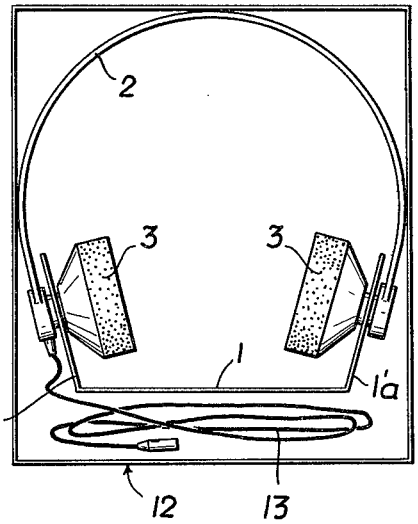
FIG. 2 is a top plan view of a container having a headset with the insert holding the headset in a protected position.

It can be seen from FIG. 2 that the headset with the inventive insert can be accommodated in a cardboard box 12. A free space is provided beneath the insert to receive the headset cable 13. The inventive insert is so deep that the earpieces cannot project therefrom, whereby, the risk that the ear pads would permanently apply against any surface and might thereby be deformed is eliminated. This detail cannot be seen in FIG. 2 which is a top plan view and for this reason has been particular pointed out separately. The figure shows, however, that the earpieces 3, 3 extend completely freely and that the headband applies against three walls of box 12 and, in practice, the motion capability of the headset is forestalled.

Figure 3:
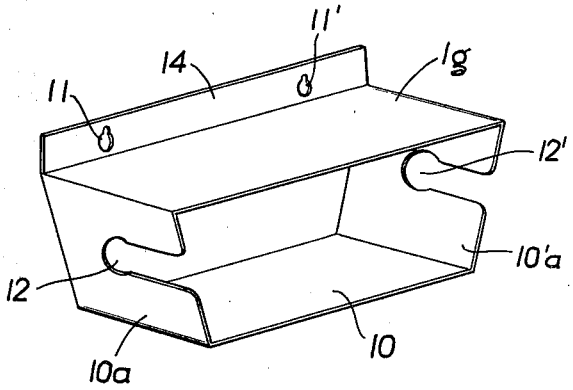
FIG. 3 is a perspective view, similar to FIG. 1, of another embodiment of the invention.

FIG. 3 shows another embodiment of the inventive insert, which is particularly suitable for display and storage. As in the simplified showing of FIG. 1, the insert shown in FIG. 3 also comprises two side panels 10*a*, 10*a'* connected to base panel 10. Slots 12, 12' are provided for holding the headset, but they do not extend vertically, but horizontally, which is due to a further provision that the two side panels 10*a*, 10*a'* are connected on their ends to a further panel 1*g* which is provided with a strip 14 having openings 11, 11' on its rear edge by means of which the insert may be suspended, for example, from a wall. With this embodiment, of course, the headset is introduced into the insert from the front side.

cation, the idea underlying the invention can be explained only with reference to simple examples. Those skilled in the art may vary the design according to application, so that with the simple embodiments shown, the possibilities are in no way exhausted. Thus, for example, the insert may comprise two parts glued together, of which the outer one would correspond approximatey to the shape shown in FIG. 1, while the inner one would be provided, in the zone of openings 8, 8' with a step intended, in the particular instance of a headset, for supporting the earphone case, so that not even strong impacts on the packing receptacle could move the earpieces which, as usual, are mounted for displacement on headband 2. In addition, slots 1*a*, 1*a'* leading to openings 8, 8' may be designed so as to form a guide for headband 2 in the zone of the earpiece.

While specific embodiments of the invention have been shown and described in detail to illustrate the application of the principles of the invention, it will be understood that the invention may be embodied otherwise without departing from such principles.

What is claimed is:

1. A packing receptacle for a headset having deformable earpieces, comprising a box and an insert which is removable from said box, said insert and the headset to be packed forming a loosely assembled unit, and said insert having a supporting base and a side wall on each end of said base engageable with said headset for providing protection against damage to said headset by maintaining a spacing between the earpieces and said box during transportion of said box, said insert base serving as a support for displaying and storing the headset to be transported in the packing receptacle, the insert comprising a base panel designed as a supporting surface having respective opposite end edges, an upwardly directed side panel rigidly connected to each edge of said supporting surface having an opening and communicating slot therein serving for fixing the headset to be packed in a definite position within and outside of said box.

2. A packing receptacle, according to claim 1, in which, at their free ends, a rear panel is connected between said upwardly extending side panels, said rear panel having a rear edge strip with an opening therethrough by which said insert can be suspended from a wall.

3. A packing receptacle for retaining and immobilizing a headset therein, comprising a rectangular container having a bottom wall and upstanding side walls and end walls, a removable packing insert comprising a base portion adapted to be spaced from one of said side walls, an end wall at each end extending upwardly from said base portion and having a headset receiving slot defined therein, said end walls extending rigidly from said base portion, and a headset comprising a head encircling band with an earpiece at each end of said band with a reduced diameter portion between said earpiece and said band engaged in a respective slot of said insert, said earpieces comprising deformable material and being retained in said packing insert in spaced relationship with the walls of said rectangular container within said container, whereby said packing insert is removable from said rectangular container for independently supporting said headset.

4. A packing receptacle, according to claim 3, wherein said insert end walls include slots extending inwardly from the outer end thereof.

5. A packing receptacle, according to claim 3, wherein said slots in said end walls include a slot extending laterally into a side of said end wall.

6. A packing receptacle, according to claim 3, wherein said insert includes a top wall portion overlying said base portion and connected to the outer ends of each of said end walls and a rear strip hinged to said top wall portion and having at least one opening therein for a fastening member.

* * * * *